US011476035B2

(12) United States Patent
Shimizu et al.

(10) Patent No.: US 11,476,035 B2
(45) Date of Patent: Oct. 18, 2022

(54) COIL COMPONENT AND METHOD FOR MANUFACTURING COIL COMPONENT

(71) Applicant: TAIYO YUDEN CO., LTD., Tokyo (JP)

(72) Inventors: Makoto Shimizu, Takasaki (JP); Tomoo Kashiwa, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 455 days.

(21) Appl. No.: 16/828,835

(22) Filed: Mar. 24, 2020

(65) Prior Publication Data

US 2020/0312523 A1 Oct. 1, 2020

(30) Foreign Application Priority Data

Mar. 29, 2019 (JP) ..... JP2019-067601

(51) Int. Cl.

| | |
|---|---|
| ***H01F 27/28*** | (2006.01) |
| ***H01F 41/06*** | (2016.01) |
| ***H01F 27/32*** | (2006.01) |
| ***H01F 27/24*** | (2006.01) |

(52) U.S. Cl.

CPC ..... *H01F 27/2804* (2013.01); *H01F 27/24* (2013.01); *H01F 27/2823* (2013.01); *H01F 27/32* (2013.01); *H01F 41/06* (2013.01)

(58) Field of Classification Search

CPC .. H01F 27/2804; H01F 27/2823; H01F 27/24; H01F 27/32; H01F 41/06

USPC ..... 336/221

See application file for complete search history.

(56) References Cited

U.S. PATENT DOCUMENTS

| | | | | |
|---|---|---|---|---|
| 2015/0028983 | A1* | 1/2015 | Ryu | H01F 1/15308 29/846 |
| 2016/0293321 | A1* | 10/2016 | Takeoka | H01F 1/14 |
| 2016/0314889 | A1* | 10/2016 | Ryu | H01F 41/0246 |
| 2019/0051445 | A1* | 2/2019 | Wada | H01F 1/34 |

FOREIGN PATENT DOCUMENTS

| | | | |
|---|---|---|---|
| JP | 2007081305 | A | 3/2007 |
| JP | 2007081306 | A | 3/2007 |
| JP | 2016127189 | A | 7/2016 |

* cited by examiner

*Primary Examiner* — Alfonso Perez Borroto

(74) *Attorney, Agent, or Firm* — Law Office of Katsuhiro Arai

(57) ABSTRACT

A coil component includes: a magnetic body part having a first compact containing a first magnetic material and a first resin, and a second compact placed on the outside of the first compact and containing a second magnetic material and a second resin; a coil formed by a conductive wire which comprises a metal conductor covered with an insulating film, and embedded in the magnetic body part; and lead parts of the coil placed on the outside of the first compact; wherein the filling rate of the first magnetic material constituting the first compact is higher than the filling rate of the second magnetic material constituting the second compact. The filling rate of magnetic grains can be improved while also ensuring the insulating property of the coil, etc.

17 Claims, 10 Drawing Sheets

COIL COMPONENT AND METHOD FOR MANUFACTURING COIL COMPONENT

CROSS-REFERENCE TO RELATED APPLICATIONS

The present application claims priority to Japanese Patent Application No. 2019-067601, filed Mar. 29, 2019, the disclosure of which is incorporated herein by reference in its entirety including any and all particular combinations of the features disclosed therein.

BACKGROUND

Field of the Invention

The present invention relates to a coil component, as well as a method for manufacturing a coil component.

Description of the Related Art

Methods for forming a coil component by filling a composite magnetic powder in a manner covering a coil and then compacting the composite magnetic powder in the axial direction of the coil, are known (Patent Literatures 1 and 2, for example). Also known are methods for forming a coil component by forming powder compacts through pressing at approx. 1 ton/cm$^2$ of a magnetic material mixed from magnetic powder and resin, and then sandwiching a coil and terminals between the powder compacts and pressing them again at approx. 5 ton/cm$^2$ (Patent Literature 3, for example).

BACKGROUND ART LITERATURES

[Patent Literature 1] Japanese Patent Laid-open No. 2007-81305

[Patent Literature 2] Japanese Patent Laid-open No. 2007-81306

[Patent Literature 3] Japanese Patent Laid-open No. 2016-127189

SUMMARY

Desirably a coil component constituted by a coil built into a magnetic body part which is formed by materials that include magnetic grains and resin, has a higher filling rate of magnetic grains in order to improve the coil properties. To increase the filling rate of magnetic grains, one idea is to compression-mold at high pressure a composite magnetic material mixed from magnetic grains and resin, to form a magnetic body part. However, if high pressure is applied to the coil when the composite magnetic material is compression-molded at high pressure to form a magnetic body part, the coil may deform, its position may shift, insulating property between the conductors forming the coil may drop, or insulating property may drop at the end parts of the coil or the electrodes, for example. In these cases, the coil properties will drop. In particular, ongoing efforts to make coil components smaller and thinner are increasing the chances of such coil deformations, etc., occurring.

The present invention was developed in light of the aforementioned problems, and its object is to improve the filling rate of magnetic grains while also ensuring the insulating property of the coil, etc.

The present invention is a coil component, which comprises: a magnetic body part having a first compact containing a first magnetic material and a first resin, and a second compact placed on the outer side of the first compact and containing a second magnetic material and a second resin; a coil formed by a conductive wire which comprises a metal conductor covered with an insulating film, and built into the magnetic body part; and lead parts of the coil placed on the outer side of the first compact; wherein the filling rate of the first magnetic material constituting the first compact is higher than the filling rate of the second magnetic material constituting the second compact.

The aforementioned constitution may be such that the first magnetic material, and the second magnetic material, represent the same material.

The aforementioned constitution may be such that the quantity of the first resin contained in the first compact is greater than the quantity of the second resin contained in the second compact.

The aforementioned constitution may be such that the first resin, and the second resin, represent the same resin material.

The aforementioned constitution may be such that the first compact has a winding shaft inserted to the inside of the winding part of the coil, and a flange part provided at least on one axial-direction end of the winding shaft.

The aforementioned constitution may be such that the second compact is provided in a manner covering the winding part of the coil and the first compact.

The aforementioned constitution may be such that the first compact has a wall part provided on the flange part in a manner surrounding the winding part of the coil which is inserted around the winding shaft.

The present invention is a method for manufacturing a coil component, which comprises: a step to prepare a coil formed by an insulating film and a metal conductor, as well as lead parts of the coil; a step to form a first compact by compression-molding at a first pressure a first composite magnetic material mixed from first magnetic grains and a first resin; a step to make a composite body by combining the first compact with the coil; and a step to form a magnetic body part having the coil by compression-molding the composite body at a second pressure; wherein, in the step to form a magnetic body part, the lead parts are placed on the outer side of the first compact, and the magnetic body part is formed through compression-molding at the second pressure which is lower than the first pressure.

The aforementioned constitution may be such that, in the step to form a magnetic body part, the magnetic body part is formed by compression-molding at the second pressure the composite body and a second composite magnetic material mixed from second magnetic grains and a second resin.

The aforementioned constitution may be such that, in the step to form a magnetic body part, the magnetic body part is formed by compression-molding the composite body and a second compact that has been formed by compression-molding at a third pressure a second composite magnetic material mixed from second magnetic grains and a second resin, at the second pressure which is lower than the third pressure.

The aforementioned constitution may be such that, in the step to form a magnetic body part, the rate of change in the dimension of the magnetic body part formed from the first compact, relative to the dimension of the first compact, when looking roughly at the center part of the magnetic body part in the direction of compression at the second pressure, is 10% or lower.

The aforementioned constitution may be such that, in the step to form a magnetic body part, the magnetic body part has its external shape formed when put in dies, and is sized so that the maximum dimension of the composite body differs from the maximum dimension between the inner faces of the dies by no more than 10%, when viewed along a plane orthogonal to the direction of compression at the second pressure.

The aforementioned constitution may be such that, in the step to form a first compact, the first compact is formed by compression-molding the first composite magnetic material under heating.

The aforementioned constitution may be such that, in the step to form a magnetic body part, the magnetic body part is formed by compression-molding the composite body under heating.

The aforementioned constitution may be such that, in the step to make a composite body, the coil is partially bent and assembled to the first compact.

The aforementioned constitution may be such that a step to form electrodes on the surface of the magnetic body part, after the magnetic body part is polished and insulated at least partially, is provided.

The aforementioned constitution may be such that the dimension of the magnetic body part in the direction of compression is 0.55 mm or smaller.

According to the present invention, the filling rate of magnetic grains can be improved, while also ensuring the insulating property of the coil and other conductor portions.

DESCRIPTION OF THE SYMBOLS

Figure 1:
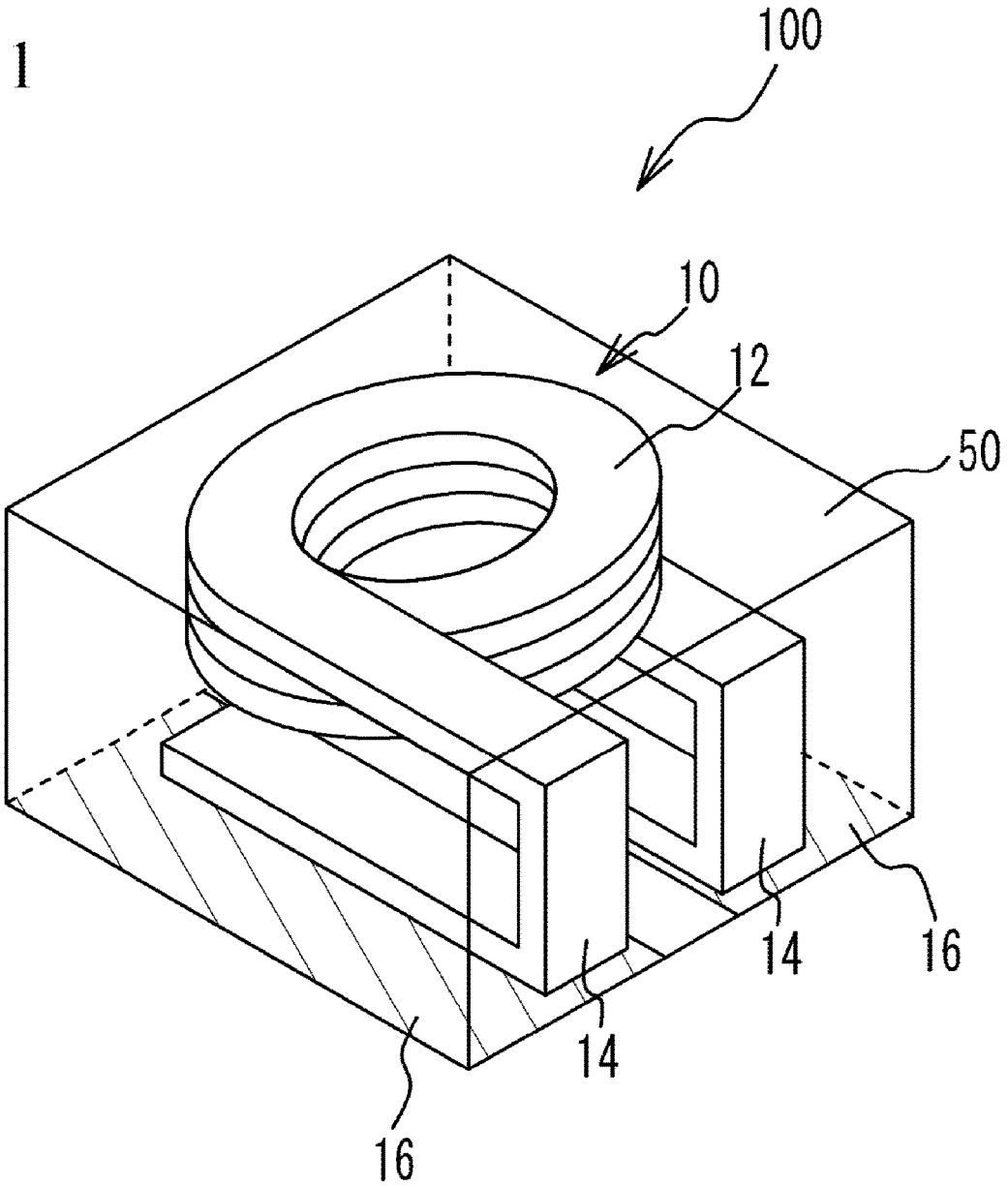
FIG. 1 is a perspective view of the coil component pertaining to Example 1.

10 Coil
12 Winding part
14 Lead part
16 Electrode
20 to 20*b* Compact
22 Winding shaft
24 Flange part
26 Wall part
30 Die
32 Bottom die
34 Top die
36 Frame die
38 Clearance
40 Composite magnetic material
50 Magnetic body part
60 to 60*b* Compact

DETAILED DESCRIPTION OF EMBODIMENTS

Examples of the present invention are explained below by referring to the drawings.

Example 1

FIG. 1 is a perspective view showing a coil component. The coil component 100 includes: a magnetic body part 50; a coil 10 embedded in the magnetic body part 50; lead parts 14 continuing to both ends of a winding part 12 of the coil 10; and electrodes 16 provided on the surface of the magnetic body part 50 and connected to the lead parts 14.

Figure 2A:
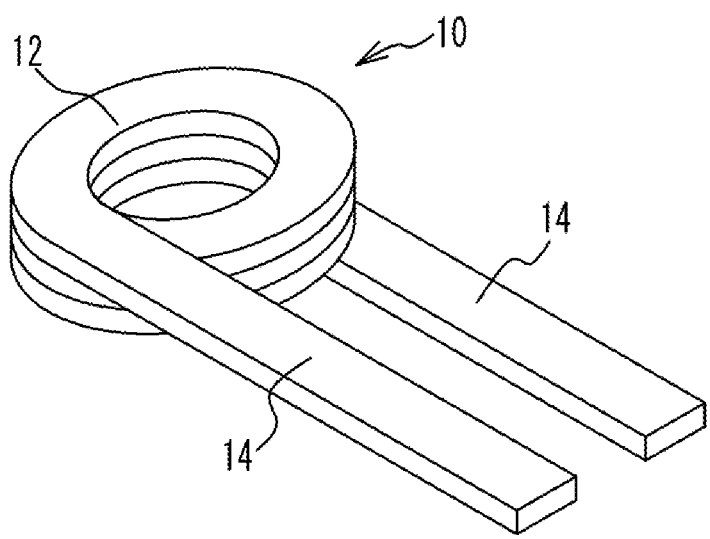
FIGS. 2A to 2C are drawings showing how the coil component pertaining to Example 1 is manufactured (part 1).

FIGS. 2A to 4B are drawings showing the manufacturing method pertaining to Example 1, or how the aforementioned coil component 100 is manufactured. As shown in FIG. 2A, a conductive wire comprising a rectangular wire is wound edge-wise to form a coil 10 having a winding part. The coil 10 has a winding part 12 where the conductive wire is wound, and two lead parts 14 that are roughly parallel to each other and having appropriate lengths of the conductive wire being led out straight from the winding part 12. The conductive wire with which to form the coil 10 is a metal conductor covered with an insulating film. The material for the metal conductor may be copper, copper alloy, silver, palladium, etc., for example, but other metal material may also be used. The material for the insulating film may be an epoxy or acrylic resin, etc., for example; however, specific examples when higher heat resistance is desired include polyester imide, polyamide, and other resin materials. In addition to the foregoing, other insulating materials may be used. When forming the coil 10, the insulating films between the conductive wires may be fused in the winding part 12, to stabilize the shape of the winding part 12.

After the coil 10 has been formed, the insulating film is stripped from the tip portions of the lead parts 14 to expose the metal conductor. The insulating film may be stripped by, for example, irradiating a laser beam or using a cutting knife, chemical agent, etc.

Figure 2B:
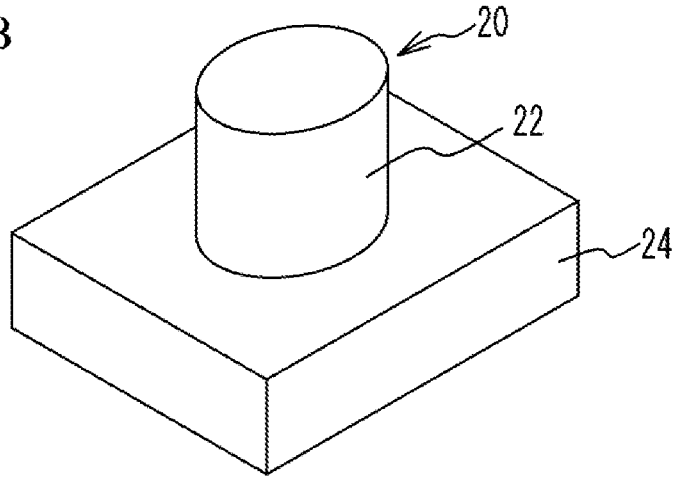

As shown in FIG. 2B, a granular composite magnetic material mixed from magnetic grains and resin is filled in dies and compression-molded to form a compact 20. The magnetic grains are Fe—Si—Cr, Fe—Si—Al, Fe—Si—Cr—Al, or other soft magnetic alloy grains, Fe, Ni, or other magnetic metal grains, amorphous metal grains, nano-magnetic metal grains, or other metal magnetic grains. They may also contain Ni—Zn or Mn—Zn ferrite or other magnetic materials, or non-magnetic materials. The resin is an epoxy resin, silicone resin, phenolic resin, or other thermosetting resin, for example. As for the magnetic grains contained in the composite magnetic material, two types of magnetic grains such as alloy magnetic grains or Fe magnetic metal grains and amorphous metal grains may be mixed, or three types of magnetic grains may be mixed, for example. Besides the grain materials, magnetic grains of different grain sizes may also be combined. As for the grain size, the average grain diameter of large grains may be 5 μm or greater, while the average grain diameter of small grains may be smaller than 1 μm, or even smaller than 0.1 μm, and metal magnetic grains such as nano-grains, etc., may also be contained. For the forming, powder compacting using a powder, sheet forming using a sheet-shaped material, or other compression-molding method may be used as deemed appropriate. The compact 20 has a structure comprising a winding shaft 22 and a flange part 24 provided on one axial-direction end of the winding shaft 22. The winding shaft 22 has a cylindrical shape, for example, and the flange part 24 has a rectangular solid shape, for example.

To increase the filling rate of magnetic grains constituting the compact 20, preferably the pressure at which to compression-mold the composite magnetic material is a high pressure. For example, it is preferably 50 MPa or higher, or more preferably 60 MPa or higher, or yet more preferably 70 MPa or higher. On the other hand, for the reason that an excessively high pressure causes the magnetic grains to deform and increases the chance of insulation dropping, it is preferably no higher than 150 MPa, or more preferably no higher than 140 MPa, or yet more preferably no higher than 130 MPa. Also, the compact 20 may be formed by compression-molding the composite magnetic material under heating. In this case, preferably the heating temperature and/or pressuring period will be adjusted to prevent the resin contained in the composite magnetic material from curing. By compression-molding the composite magnetic material under heating, the filling rate of the magnetic material constituting the compact 20 can be increased compared to when the composite magnetic material is compression-molded without heating, even if the compression-molding pressure is kept low. In the interest of keeping the compression-molding pressure low, the heating temperature is preferably 100° C. or higher, or more preferably 150° C. or higher. On the other hand, for the reason that a higher heating temperature makes the resin more likely to cure, the heating temperature is preferably no higher than 300° C., or more preferably no higher than 200° C. One example of the pressure at which to compression-mold the composite magnetic material under heating is 20 MPa, as it can provide a compact equivalent to what can be obtained at 50 MPa under the aforementioned unheated condition (normal temperature). Thus, by compression-molding the composite magnetic material under heating, the pressure can be lowered by approx. 20 to 50%, preventing deformation of the magnetic grains and increasing the filling rate of the magnetic material.

Figure 2C:
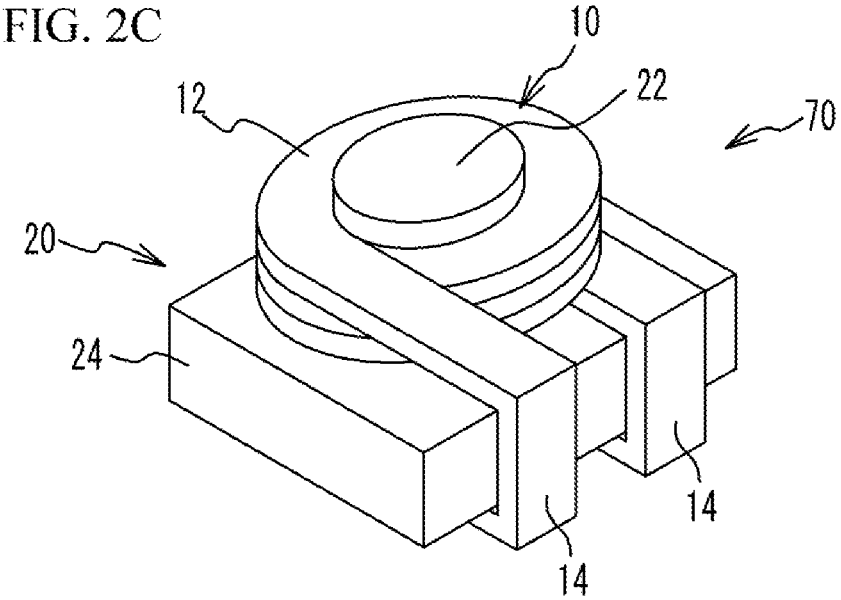

As shown in FIG. 2C, the coil 10 is mounted on the top face of the flange part 24 of the compact 20 in a manner allowing the air core part of the coil 10 to be inserted around the winding shaft 22. Next, a forming process is performed to bend the lead parts 14 of the coil 10, so that the tip portions of the lead parts 14 (portions where the insulating film has been stripped and the metal conductor is exposed) are positioned on the bottom face of the flange part 24. Now, a composite body 70 comprising the compact 20 combined with the coil 10, has been formed.

Figure 3A:
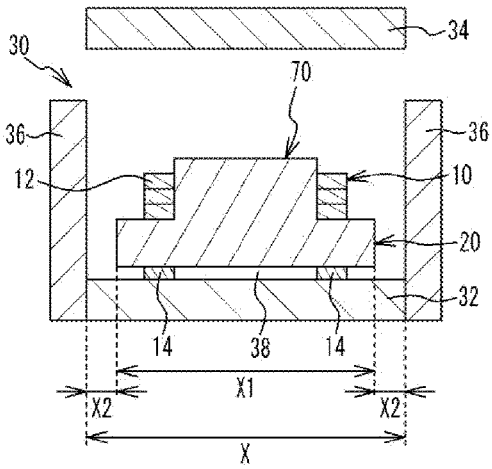
FIGS. 3A to 3D are drawings showing how the coil component pertaining to Example 1 is manufactured (part 2).
Figure 4A:
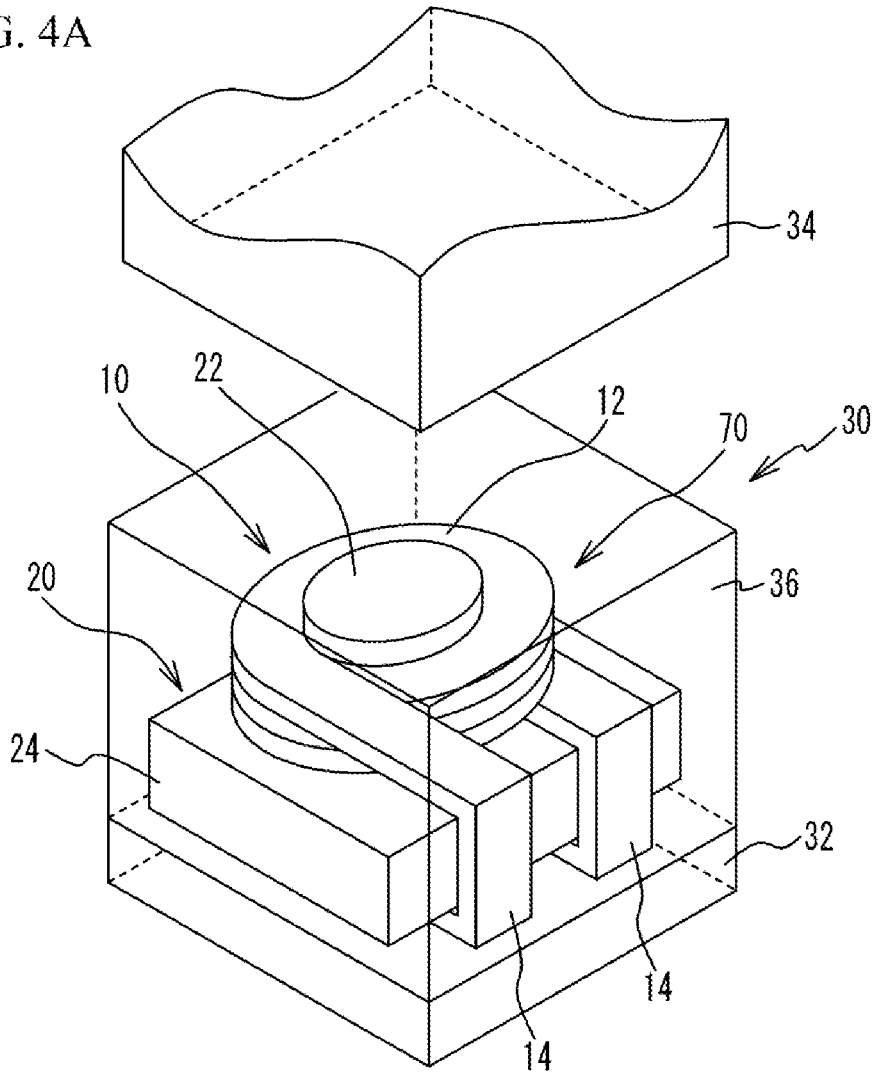
FIGS. 4A and 4B are drawings showing how the coil component pertaining to Example 1 is manufactured (part 3).

The composite body 70 is placed in dies 30 as shown in FIGS. 3A and 4A. The dies 30 comprise a bottom die 32, a top die 34, and a frame die 36. The bottom die 32 and top die 34 are movable in the up/down directions with respect to the frame die 36. The composite body 70 is placed on the bottom die 32 inside the space surrounded by the bottom die 32 and the frame die 36. Between the composite body 70 and the bottom die 32 is a clearance 38 whose width is no more than the thickness of the conductive wire forming the coil 10. Also, the size of the spacing X2 between the composite body 70 and the frame die 36 is no more than 5% of the maximum external dimension X1 of the compact 20. It should be noted that, in FIG. 4A, the composite body 70 is shown through the frame die 36.

Figure 3B:
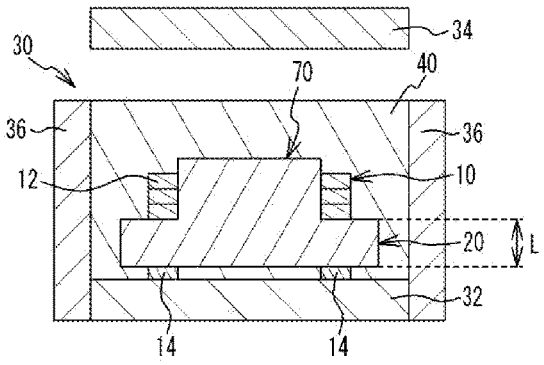

As shown in FIG. 3B, a granular composite magnetic material 40 mixed from magnetic grains and resin is filled in the space surrounded by the bottom die 32 and the frame die 36. The quantity of resin contained in the composite magnetic material 40 is set to, for example, less than the quantity of resin contained in the composite magnetic material used when the compact 20 was formed. The composite magnetic material 40 is also filled in the clearance 38 between the composite body 70 and the bottom die 32, and in the clearances between the composite body 70 and the frame die 36. Now, the composite body 70 has been embedded in the composite magnetic material 40. The magnetic grains contained in the composite magnetic material 40 are Fe—Si—Cr, Fe—Si—Al, Fe—Si—Cr—Al, or other soft magnetic alloy grains, Fe, Ni, or other magnetic metal grains, amorphous metal grains, nano-magnetic metal grains, or other metal magnetic grains. They may also contain Ni—Zn or Mn—Zn ferrite or other magnetic materials, or non-magnetic materials. As for the magnetic grains contained in the composite magnetic material 40, two types of magnetic grains such as alloy magnetic grains or Fe magnetic metal grains and amorphous metal grains may be mixed, or three types of magnetic grains may be mixed, for example. Besides the grain materials, magnetic grains of different grain sizes may also be combined. As for the grain size, the average grain diameter of large grains may be 5 μm or greater, while the average grain diameter of small grains may be smaller than 1 μm, or even smaller than 0.1 μm, and metal magnetic grains such as nano-grains, etc., may also be contained. The resin contained in the composite magnetic material 40 is an epoxy resin, silicone resin, phenolic resin, or other thermosetting resin, for example.

Figure 3C:
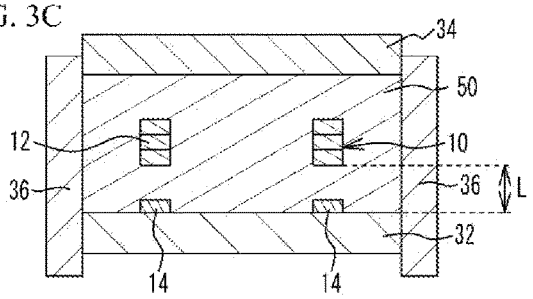

As shown in FIG. 3C, the bottom die 32 and top die 34 are moved to compression-mold the composite body 70 and composite magnetic material 40, to form a magnetic body part 50 embedded with the coil 10. The directions corresponding to the up/down directions in which the bottom die 32 and top die 34 are movable with respect to the frame die 36, represent the pressurizing directions. The pressure at which to form the magnetic body part 50 through compression molding is lower than the pressure at which the compact 20 was formed through compression molding, in order to inhibit damage to the coil 10. The pressure at which to form the magnetic body part 50 through compression molding may be set to 50 MPa or higher, or 60 MPa or higher, or 70 MPa or higher. Here, in the interest of inhibiting damage to the coil 10, the forming pressure of the compact 20 is referred to as a first pressure and the forming pressure of the magnetic body part 50 is referred to as a second pressure, and the first pressure is set high and the second pressure is set lower than the first pressure. The higher the first pressure, the lower the second pressure can be, which is preferably no higher than 100 MPa, or more preferably no higher than 90 MPa, or yet more preferably no higher than 80 MPa.

When forming the magnetic body part 50 through compression molding, the composite body 70 and composite magnetic material 40 may be compression-molded under heating. In this case, preferably the heating temperature and/or pressuring period will be adjusted to prevent the resin contained in the compact 20, and the resin contained in the composite magnetic material 40, from curing. By compression-molding the composite body 70 and composite magnetic material 40 under heating, the magnetic body part 50 can be formed by keeping the compression-molding pressure low, which allows for effective inhibition of damage to the coil 10. In the interest of keeping the compression-molding pressure low to inhibit damage to the coil 10, the heating temperature is preferably 100° C. or higher, or more preferably 150° C. or higher. On the other hand, for the reason that too high a heating temperature makes it difficult to prevent curing of resin, even when the pressuring period is adjusted, the heating temperature is preferably no higher than 300° C., or more preferably no higher than 200° C. One example of the pressure at which to compression-mold the composite magnetic material 40 under heating is 10 MPa or higher but no higher than 50 MPa.

Figure 3D:
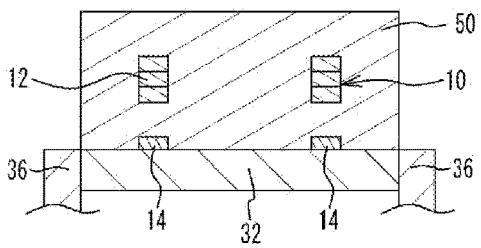
Figure 4B:
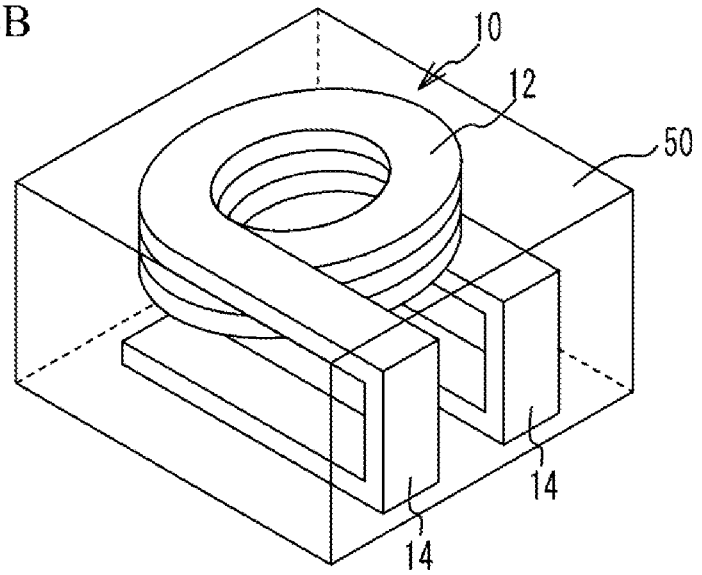

As shown in FIG. 3D, the bottom die 32 and top die 34 are removed to take out the magnetic body part 50 with the built-in coil 10. FIG. 4B shows the magnetic body part 50 that has been taken out of the dies 30. It should be noted that, in FIG. 4B, the coil 10 is shown through the magnetic body part 50. The tip portions of the lead parts 14 of the coil 10 are exposed from the bottom face of the magnetic body part 50. If the tip portions of the lead parts 14 are not sufficiently exposed, or not exposed at all, from the bottom face of the magnetic body part 50, the magnetic body part 50 may be polished or blasted to expose the tip portions of the lead parts 14 from the bottom face of the magnetic body part 50.

Once taken out of the dies 30, the magnetic body part 50 is heat-treated to cure the resin contained in the magnetic body part 50. The heating temperature for this may be a higher temperature than the heating temperature used when the composite magnetic material 40 and composite body 70 are heated as the magnetic body part 50 is formed. For example, it may be set to 100° C. or higher but no higher than 200° C., or 120° C. or higher but no higher than 200° C., or 140° C. or higher but no higher than 200° C. This ensures curing of the resin. As shown in FIG. 1, a metal film is deposited by the sputtering method, plating method, etc., to form electrodes 16 on the tip portions of the lead parts 14 exposed on the bottom face of the magnetic body part 50. The coil component 100 is manufactured through steps including the foregoing.

According to Example 1, the compact 20 is formed by compression-molding, at the first pressure, the composite magnetic material mixed from magnetic grains and resin, as shown in FIG. 2B. As shown in FIG. 2C, the compact 20 is combined with the coil 10 into the composite body 70. As shown in FIGS. 3B and 3C, the composite body 70 is compression-molded at the second pressure lower than the first pressure at which the compact 20 was formed, to form the magnetic body part 50 having the coil 10. According to this manufacturing method, no load will apply to the coil 10 even when the composite magnetic material is compression-molded at a higher first pressure and a compact 20 with a higher filling rate of magnetic grains is formed. By using the second pressure lower than the first pressure at which the compact 20 was formed, to form the magnetic body part 50 having the coil 10, application of load to the coil 10 is prevented. As a result, the filling rate of magnetic grains constituting the magnetic body part 50 can be improved, while at the same time application of load to the coil 10 can be inhibited to ensure insulating property of the coil 10 and other conductor portions. For example, the filling rate of magnetic grains constituting the portions of the magnetic body part 10 through which the magnetic flux of the coil 10 will pass, can be adjusted to 88 percent by volume or higher. In addition, since application of load to the coil 10 is inhibited, the magnetic body part 50 can be made thinner, to a thickness of 0.55 mm or smaller, for example. In this case, the thickness direction corresponds to the pressuring direction, which means that thinning can be achieved in the compressing direction.

As shown in FIGS. 3A to 3C, preferably the composite body 70 is placed in the dies 30, after which the composite magnetic material 40 mixed from magnetic grains and resin is filled in the dies 30. Then, the composite body 70 and composite magnetic material 40 are compression-molded at the second pressure lower than the first pressure at which the compact 20 was formed, to form the magnetic body part 50 having the coil 10. In other words, preferably the composite body 70 and composite magnetic material 40 are compression-molded at the second pressure lower than the first pressure at which the compact 20 was formed, to form the magnetic body part 50 having the coil 10. This can inhibit the coil 10 from moving before or after the compression molding through which the magnetic body part 50 is formed. As a result, changing of the coil properties can be prevented. Also, a thin magnetic body part 50 can be formed with ease.

As shown in FIG. 3A, preferably the spacing X2 between the widest portion of the compact 20 and the inner face of the die 30 (inner face of the frame die 36) is no greater than 5% of the widest dimension X1 of the compact 20. In other words, preferably the maximum dimension of the composite body 70 differs from the maximum dimension X between the inner faces of the dies 30 by no more than 10%, when viewed along a plane orthogonal to the direction of compression at the second pressure when the magnetic body part 50 is formed. This reduces any deformation the compact 20 may undergo when the magnetic body part 50 is formed, which can in turn inhibit decrease in the areas of the magnetic body part 50 where the filling rate of magnetic grains is high. Also, because deformation of the compact 20 is reduced, it can inhibit embedding of the magnetic body part 50 in the corners of the dies 30 from becoming difficult.

As shown in FIGS. 3B and 3C, preferably the rate of change in the spacing L between the inner bottom face of the die 30 (top face of the bottom die 32) and the coil 10, between before and after the compression molding through which to form the magnetic body part 50, is 10% or lower. In other words, preferably the rate of change in the dimension of the magnetic body part 50 formed from the compact 20, relative to the dimension of the compact 20, when looking roughly at the center part of the magnetic body part 50 in the direction of compression at the second pressure, is 10% or lower. This inhibits the coil 10 from shifting in position, which in turn inhibits the coil 10 from tilting, for example. As a result, changing of the coil properties can be prevented.

As explained using FIG. 2B, preferably the compact 20 is formed by compression-molding the composite magnetic material under heating. This way, the filling rate of the magnetic material constituting the compact 20 can be increased, even when the compression-molding pressure is kept low. Because the compression-folding pressure is kept low, deformation of the magnetic grains can be inhibited.

As explained using FIG. 3C, preferably the magnetic body part 50 is formed by compression-molding the composite body 70 and composite magnetic material 40 under heating. This way, the compression-molding pressure can be kept low, and consequently any load applied to the coil 10 can be suppressed effectively. The temperature to which the composite body 70 and composite magnetic material 40 are heated when the magnetic body part 50 is formed per FIG. 3C is preferably higher than, or more preferably at least 1.5 times, or yet more preferably at least 2.0 times, the temperature to which the composite magnetic material is heated when the compact 20 is formed per FIG. 2B. The higher the temperature to which the composite body 70 and composite magnetic material 40 are heated, the lower the pressure can be kept when the magnetic body part 50 is formed through compression molding and consequently any load applied to the coil 10 can be suppressed.

As shown in FIG. 2B, preferably a compact 20 having a winding shaft 22 and a flange part 24, is formed. As shown in FIG. 2C, preferably the coil 10 is combined with the compact 20, in a manner allowing the air core part of the coil 10 to be inserted around the winding shaft 22. This allows the compact 20 with a higher filling rate of magnetic grains to be placed in the air core part through which the magnetic flux of the coil 10 will pass, and consequently the coil properties can be improved effectively.

Preferably the magnetic grains and resin contained in the composite magnetic material used when the compact 20 is formed, are the same materials as the magnetic grains and resin contained in the composite magnetic material 40 used when the magnetic body part 50 is formed. This allows the magnetic flux to be provided uniformly throughout the compact 20, to inhibit local magnetic saturations.

Example 2

Figure 5A:
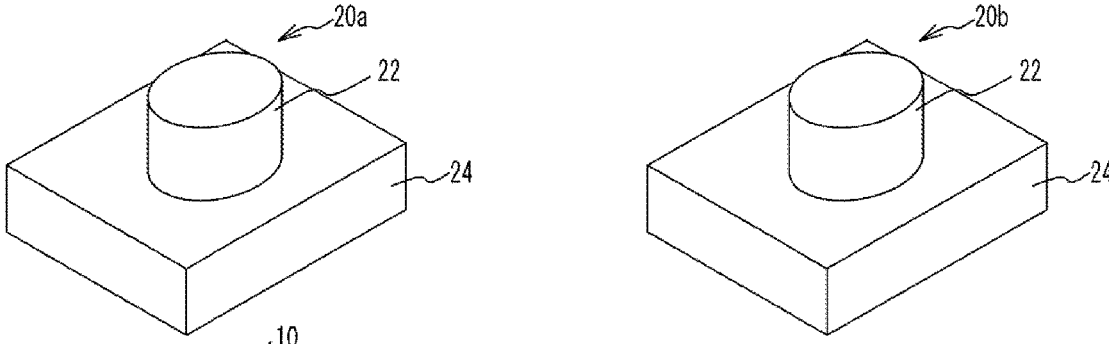
FIGS. 5A and 5B are drawings showing how the coil component pertaining to Example 2 is manufactured (part 1).
Figure 5B:
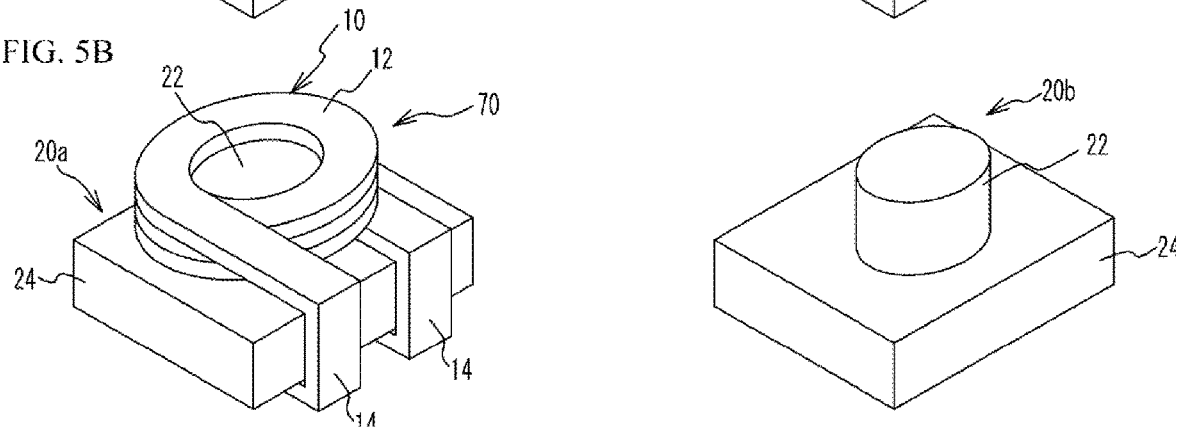

FIGS. 5A to 6C are drawings showing how the coil component pertaining to Example 2 is manufactured. As shown in FIG. 5A, compacts 20*a*, 20*b* are formed by filling in dies and compression-molding a composite magnetic material mixed from magnetic grains and resin. It should be noted that the compacts 20*a*, 20*b* may be formed by compression-molding the composite magnetic material under heating. As shown in FIG. 5B, a coil 10 is mounted on the top face of the flange part 24 of the compact 20*a* in a manner allowing the air core part of the coil 10 to be inserted around the winding shaft 22 of the compact 20*a*. Next, the insulating film is stripped from the tip portions of the lead parts 14 of the coil 10, after which a forming process is performed to bend the lead parts 14 so that the tip portions where the insulating film has been stripped are positioned on the bottom face of the flange part 24.

Figure 6A:
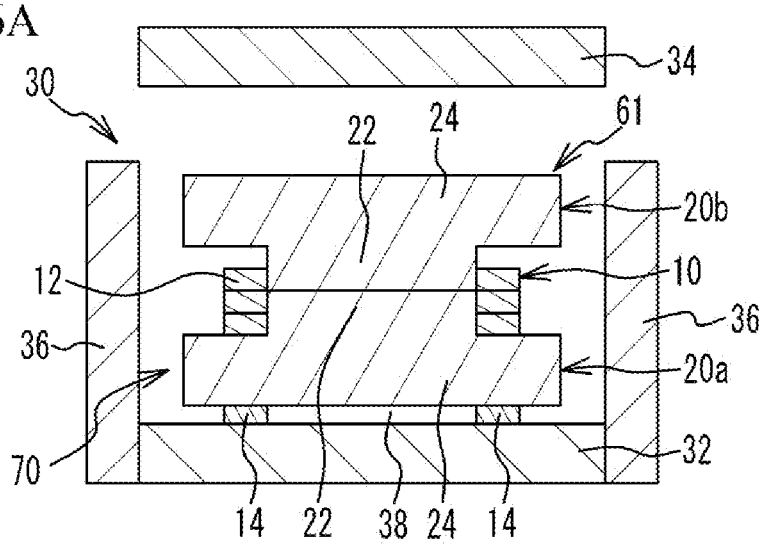
FIGS. 6A to 6C are drawings showing how the coil component pertaining to Example 2 is manufactured (part 2).

As shown in FIG. 6A, the winding shaft 22 of the compact 20*a* and the winding shaft 22 of the compact 20*b* are brought into contact, so that the winding part 12 of the coil 10 is sandwiched between the compact 20*a* and the compact 20*b*. In other words, the coil 10 is mounted between the compact 20*a* and the compact 20*b* in a manner being sandwiched by the compact 20*a* and the compact 20*b*. Hereinafter, the structure wherein the coil 10 is sandwiched between the compact 20*a* and the compact 20*b* is referred to as a structured body 61. The structured body 61 is placed in dies 30, or specifically on a bottom die 32 inside the space surrounded by the bottom die 32 and a frame die 36.

Figure 6B:
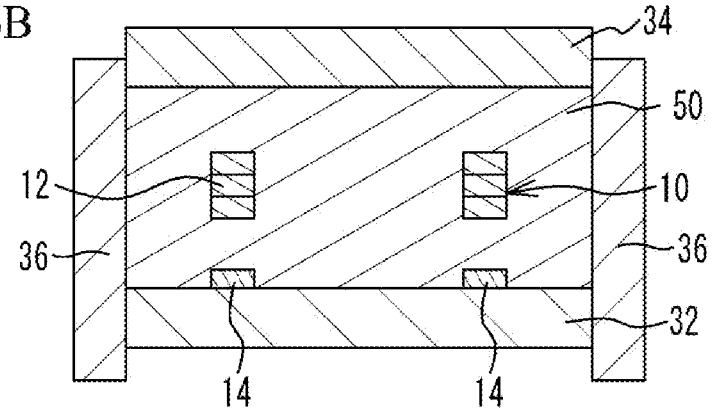

As shown in FIG. 6B, the bottom die 32 and top die 34 are moved to compression-mold the compacts 20*a*, 20*b*, to form a magnetic body part 50 embedded with the coil 10. The pressure at which to compression-mold the magnetic body part 50 shall be, as in Example 1, a pressure lower than the pressure at which the compacts 20*a*, 20*b* were compression-molded, to inhibit damage to the coil 10. It should be noted that the magnetic body part 50 may be formed by compression-molding the formed bodies 20*a*, 20*b* under heating.

The filling rate of magnetic grains constituting the magnetic body part 50 is higher than the filling rate of magnetic grains constituting the compacts 20*a*, 20*b*, and preferably it is kept to a change of no more than 10% relative to the filling rate of magnetic grains constituting the compacts 20*a*, 20*b*. By keeping low the change in the filling rate of magnetic grains this way, deformation of the coil 10 can be inhibited.

Figure 6C:
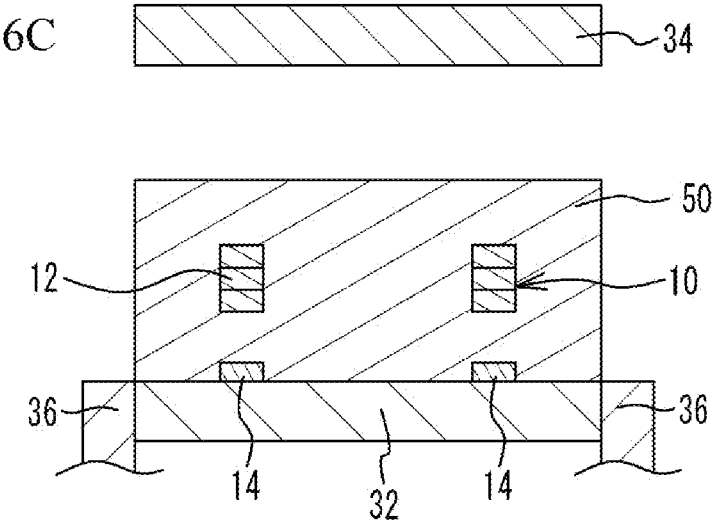

As shown in FIG. 6C, the bottom die 32 and top die 34 are removed to take out the magnetic body part 50 with the built-in coil 10. This is followed by a heat treatment to cure the resin contained in the magnetic body part 50, and formation of electrodes 16 on the tip portions of the lead parts 14 exposed on the bottom face of the magnetic body part 50. The coil component in Example 2 is manufactured through steps including the foregoing.

According to Example 2, the compact 20*a* and compact 20*b* are formed by compression-molding the composite magnetic material mixed from magnetic grains and resin, as shown in FIG. 5A. As shown in FIG. 6A, the coil 10 is mounted between the compact 20*a* and the compact 20*b* in a manner being sandwiched by the compact 20*a* and the compact 20*b*. As shown in FIGS. 6A and 6B, the compacts 20*a*, 20*b* sandwiching the coil 10 are placed in the dies 30, after which the compacts 20*a*, 20*b* are compression-molded at a pressure lower than the pressure at which the compacts 20*a*, 20*b* were formed, thereby forming the magnetic body part 50 with the built-in coil 10. According to this manufacturing method, the distance over which the magnetic flux of the coil 10 will pass in the areas with a higher filling rate of magnetic grains becomes longer, and consequently the coil properties can be improved further.

Example 3

Figure 7A:
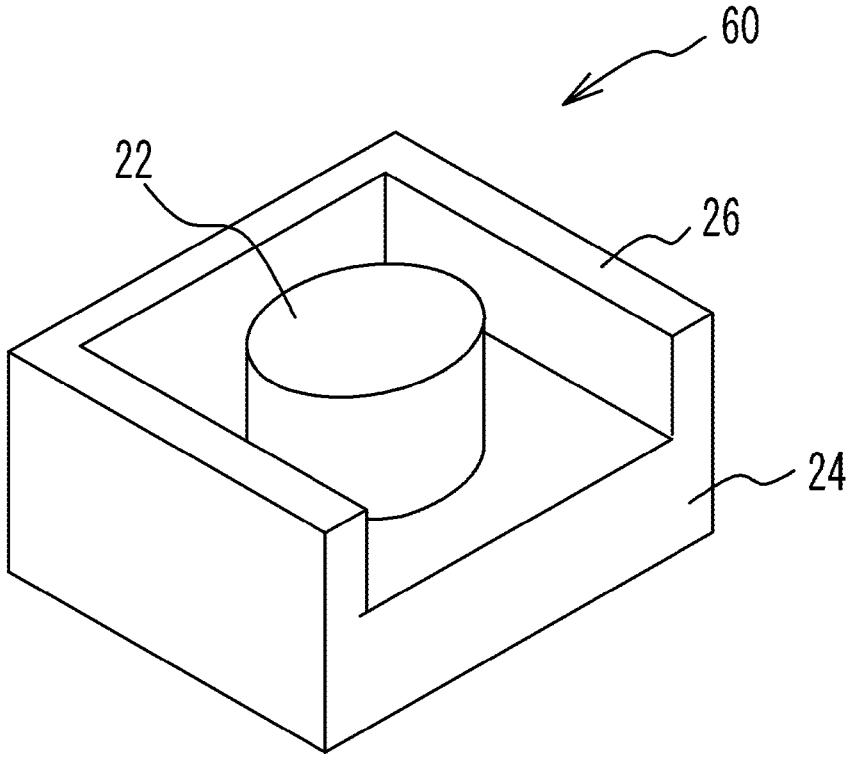
FIGS. 7A and 7B are drawings showing how the coil component pertaining to Example 3 is manufactured (part 1).

FIGS. 7A to 8D are drawings showing how the coil component pertaining to Example 3 is manufactured. As shown in FIG. 7A, a composite magnetic material mixed from magnetic grains and resin is filled in dies and compression-molded, to form a compact 60. It should be noted that the compact 60 may be formed by compression-molding the composite magnetic material under heating. The compact 60 is structured in such a way that, compared to the compact 20 in Example 1, it has, in addition to a winding shaft 22 and a flange part 24, a wall part 26 provided on the flange part 24 in a manner surrounding the winding shaft 22 from three directions. The magnetic grains may be, as in Example 1, Ni—Zn, Mn—Zn, or other ferrite magnetic grains, Fe—Si—Cr, Fe—Si—Al, Fe—Si—Cr—Al, or other soft magnetic alloy grains, Fe, Ni, or other magnetic metal grains, amorphous metal grains, nano-magnetic metal grains, or other metal magnetic grains, for example. The resin is, as in Example 1, an epoxy resin, silicone resin, phenolic resin, or other thermosetting resin, for example.

Figure 7B:
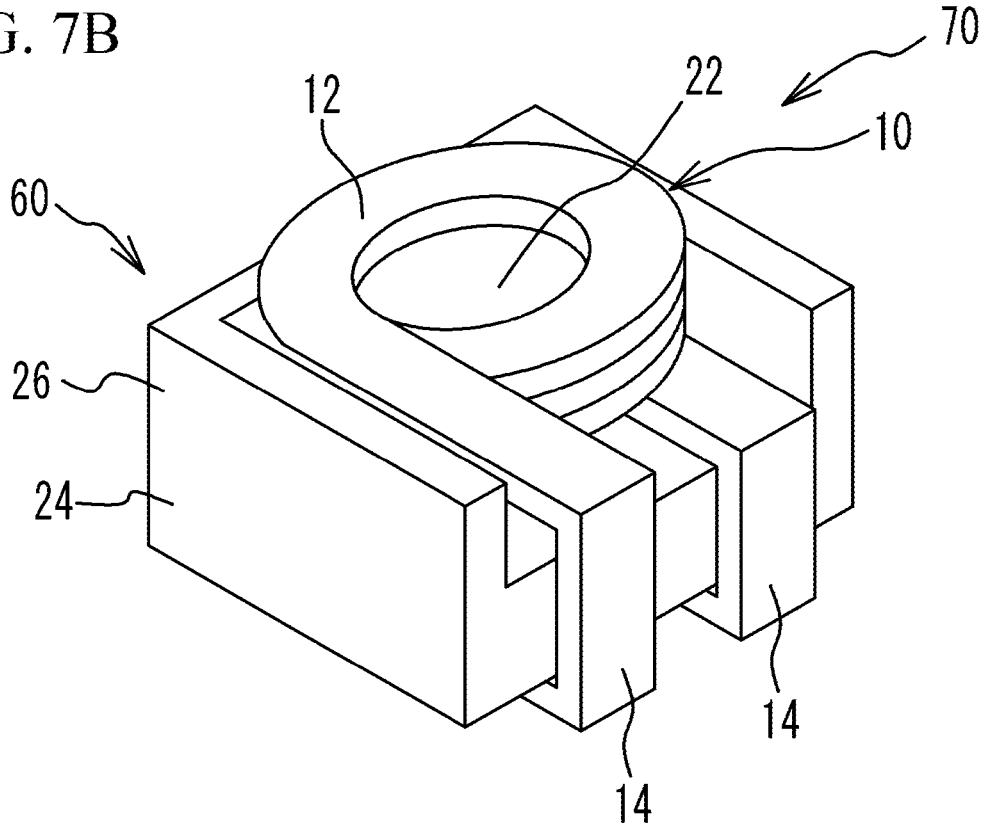

As shown in FIG. 7B, a coil 10 is mounted on the top face of the flange part 24 of the compact 60, in a manner allowing the air core part of the coil 10 to be inserted around the winding shaft 22 of the compact 60. The coil 10 is now surrounded by the wall part 26 in three directions. Next, the insulating film is stripped from the tip portions of the lead parts 14 of the coil 10, after which a forming process is performed to bend the lead parts 14 so that the tip portions where the insulating film has been stripped are positioned on the bottom face of the flange part 24.

Figure 8A:
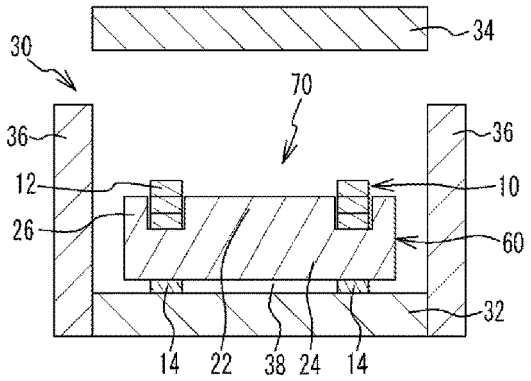
FIGS. 8A to 8D are drawings showing how the coil component pertaining to Example 3 is manufactured (part 2).

As shown in FIG. 8A, the compact 60 on which the coil 10 has been mounted is placed in dies 30. The compact 60 is placed on a bottom die 32 inside the space surrounded by the bottom die 32 and a frame die 36.

Figure 8B:
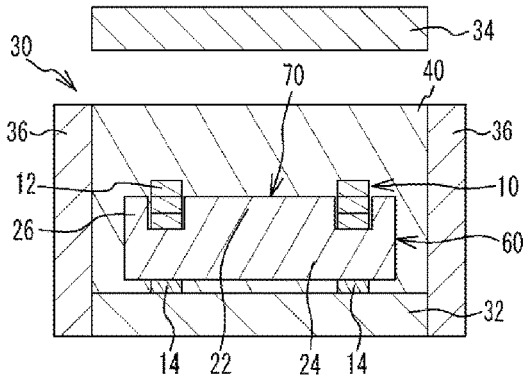

As shown in FIG. 8B, a composite magnetic material 40 mixed from magnetic grains and resin is filled in the space surrounded by the bottom die 32 and the frame die 36. This way, the compact 60 on which the coil 10 has been mounted is embedded in the composite magnetic material 40.

Figure 8C:
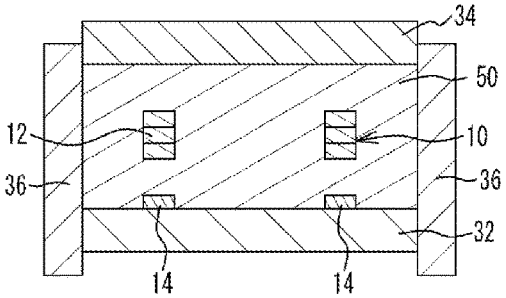

As shown in FIG. 8C, the bottom die 32 and top die 34 are moved to compression-mold the compact 60 on which the coil 10 has been mounted, and the composite magnetic material 40, to form a magnetic body part 50 embedded with the coil 10. The pressure at which to compression-mold the magnetic body part 50 shall be, as in Example 1, a pressure lower than the pressure at which the compact 60 was compression-molded, in order to inhibit damage to the coil 10. It should be noted that the magnetic body part 50 may be formed by compression-molding the compact 60 and composite magnetic material 40 under heating.

Figure 8D:
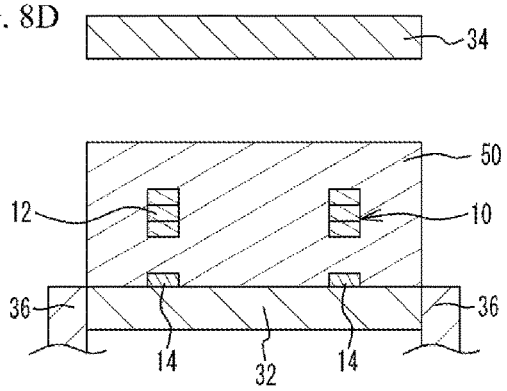

As shown in FIG. 8D, the bottom die 32 and top die 34 are removed to take out the magnetic body part 50 with the built-in coil 10. This is followed by a heat treatment to cure the resin contained in the magnetic body part 50, and formation of electrodes 16 on the tip portions of the lead parts 14 exposed on the bottom face of the magnetic body part 50. The coil component in Example 3 is manufactured through steps including the foregoing.

According to Example 3, the compact 60 having the winding shaft 22, flange part 24, and wall part 26 provided on the flange part 24 in a manner surrounding the winding shaft 22, is formed, as shown in FIG. 7A. As shown in FIG. 7B, the coil 10 is mounted on the compact 60 in a manner allowing the air core part of the coil 10 to be inserted around the winding shaft 22 and the coil 10, surrounded by the wall part 26. This way, the distance over which the magnetic flux of the coil 10 will pass in the areas with a higher filling rate of magnetic grains becomes longer, and consequently the coil properties can be improved effectively.

Example 4

Figure 9A:
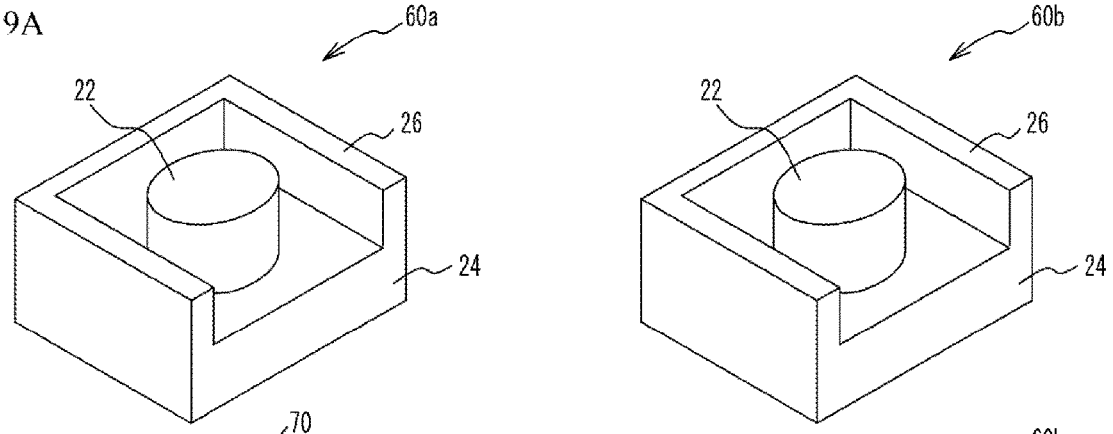
FIGS. 9A and 9B are drawings showing how the coil component pertaining to Example 4 is manufactured (part 1).
Figure 9B:
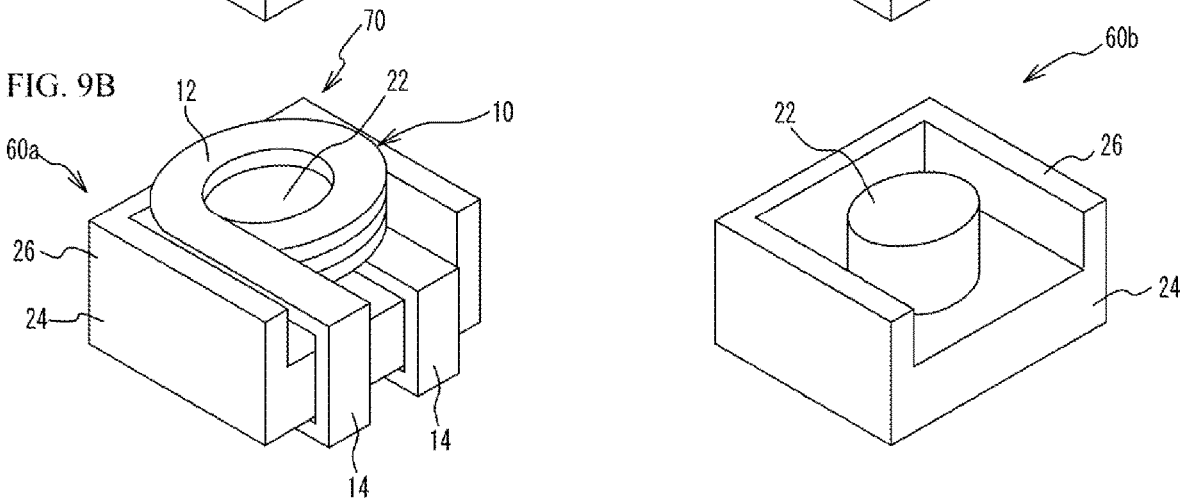

FIGS. 9A to 10C are drawings showing how the coil component pertaining to Example 4 is manufactured. As shown in FIG. 9A, a composite magnetic material mixed from magnetic grains and resin is filled in dies and compression-molded, to form compacts 60*a*, 60*b*. It should be noted that the compacts 60*a*, 60*b* may be formed by compression-molding the composite magnetic material under heating. As shown in FIG. 9B, a coil 10 is mounted on the top face of the flange part 24 of the compact 60*a* in a manner allowing the air core part of the coil 10 to be inserted around the winding shaft 22 of the compact 60*a* and the coil 10, surrounded by the wall part 26 of the compact 60*a*. Next, the insulating film is stripped from the tip portions of the lead parts 14 of the coil 10, followed by a forming process to bend the lead parts 14, so that the tip portions where the insulating film has been stripped are positioned on the bottom face of the flange part 24.

Figure 10A:
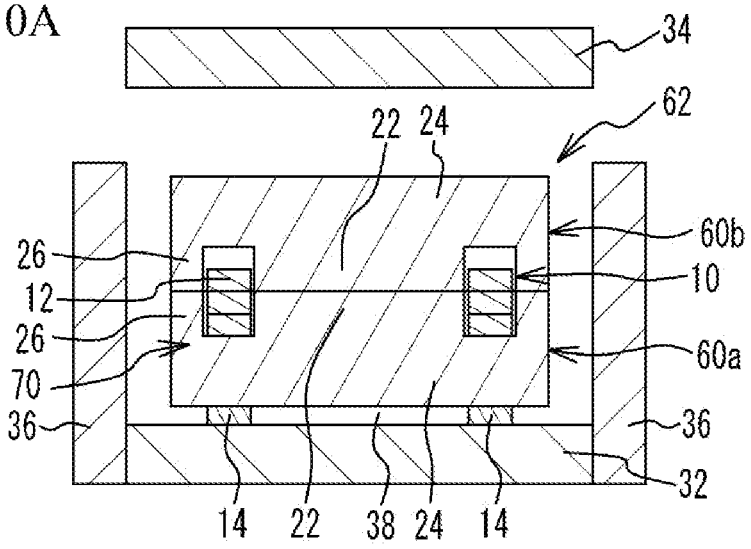
FIGS. 10A to 10C are drawings showing how the coil component pertaining to Example 4 is manufactured (part 2).

As shown in FIG. 10A, the winding shaft 22 and wall part 26 of the compact 60*a* and the winding shaft 22 and wall part 26 of the compact 60*b* are brought into contact, so that the winding part 12 of the coil 10 is sandwiched between the compact 60*a* and the compact 60*b*. In other words, the coil 10 is mounted between the compact 60*a* and the compact 60*b* in a manner being sandwiched by the compact 60*a* and the compact 60*b*. The winding part 12 of the coil 10 is surrounded by the wall parts 26 of the compacts 60*a*, 60*b*. Hereinafter, the structure wherein the coil 10 is sandwiched between the compact 60*a* and the compact 60*b* is referred to as a "structured body 62." The structured body 62 is placed in dies 30, or specifically on a bottom die 32 inside the space surrounded by the bottom die 32 and a frame die 36.

Figure 10B:
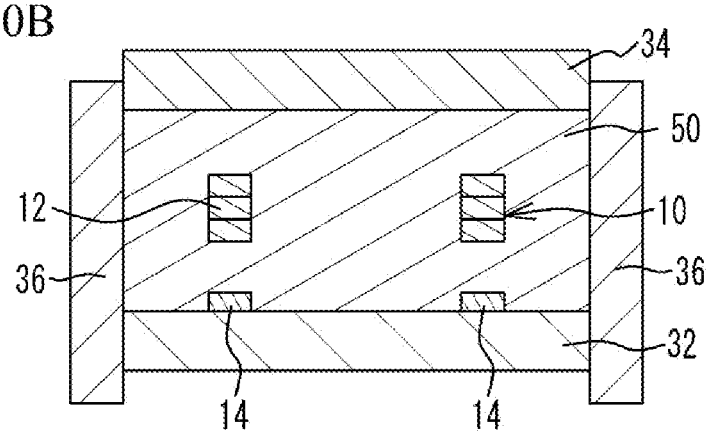

As shown in FIG. 10B, the bottom die 32 and top die 34 are moved to compression-mold the compacts 60*a*, 60*b*, to form a magnetic body part 50 embedded with the coil 10. The pressure at which to compression-mold the magnetic body part 50 shall be, as in Example 1, a pressure lower than the pressure at which the formed bodies 60*a*, 60*b* were compression-molded, to inhibit damage to the coil 10. It should be noted that the magnetic body part 50 may be formed by compression-molding the compacts 60*a*, 60*b* under heating.

Figure 10C:
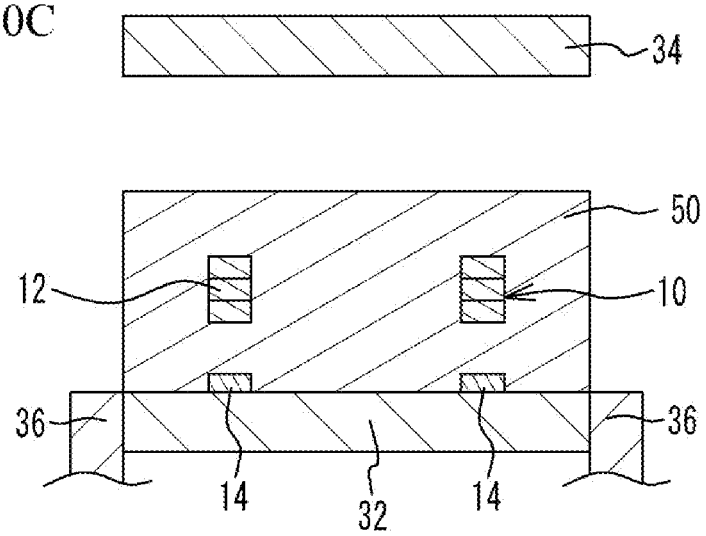

As shown in FIG. 10C, the bottom die 32 and top die 34 are removed to take out the magnetic body part 50 with the built-in coil 10. This is followed by a heat treatment to cure the resin contained in the magnetic body part 50, and a formation of electrodes 16 on the tip portions of the lead parts 14 exposed on the bottom face of the magnetic body part 50. The coil component in Example 4 is manufactured through steps including the foregoing.

According to Example 4, the coil 10 is mounted between the compact 60*a* and the compact 60*b* in a manner being sandwiched by the compact 60*a* and the compact 60*b*. Then, the compacts 60*a*, 60*b* are compression-molded at a pressure lower than the pressure at which the compacts 60*a*, 60*b* were formed, to form the magnetic body part 50 with the built-in coil 10. According to this manufacturing method, the distance over which the magnetic flux of the coil 10 will pass in the areas with a higher filling rate of magnetic grains becomes longer, and consequently the coil properties can be improved effectively.

While Examples 1 to 4 illustrated examples where the coil 10 had a winding part, it may be other than an air-core coil. The coil 10 is not limited to an edge-wise-wound conductive wire comprising a rectangular wire with a rectangular cross-section shape as described in the illustrated examples. The coil 10 may be a conductive wire which is alpha-wound or wound by other methods. The conductive wire need not comprise a rectangular wire and may be, for example, a round wire with a circular cross-section shape or have other shapes. Also, the coil 10 need not be formed by a wound conductive wire, and it may be formed by a thin film.

The foregoing described the examples of the present invention in detail; it should be noted, however, that the present invention is not limited to these specific examples and various modifications and changes may be added to the extent that they do not affect the key points of the present invention as described in "What is Claimed is."

We claim:

1. A coil component, comprising:

a magnetic body part constituted by: a first compact which is integrally formed and contains a first magnetic material and a first resin; and a second compact which is not the first compact, is integrally formed and placed on and in contact with an outside of the first compact, and contains a second magnetic material and a second resin;

a coil formed by a conductive wire which comprises a metal conductor covered with an insulating film, said coil being embedded in the magnetic body part wherein the coil is in contact with the first compact and the second compact; and lead parts of the coil placed on an outside of the first compact;

wherein a filling rate of the first magnetic material constituting the first compact is higher than a filling rate of the second magnetic material constituting the second compact.

2. The coil component according to claim 1, wherein the first magnetic material and the second magnetic material are a same material.

3. The coil component according to claim 1, wherein a quantity of the first resin contained in the first compact is greater than a quantity of the second resin contained in the second compact.

4. The coil component according to claim 1, wherein the first resin and the second resin are a same resin material.

5. The coil component according to claim 1, wherein the first compact has a winding shaft inserted to an inside of a winding part of the coil, and a flange part provided at least on one axial-direction end of the winding shaft.

6. The coil component according to claim 5, wherein the second compact is provided in a manner covering the winding part of the coil and the first compact.

7. The coil component according to claim 5, wherein the first compact has a wall part provided on the flange part in a manner surrounding the winding part of the coil which is inserted around the winding shaft.

8. A method for manufacturing a coil component, comprising steps of:

providing a coil formed by an insulating film and a metal conductor, as well as lead parts of the coil;

forming a first compact by compression-molding at a first pressure a first composite magnetic material constituted by a mixture of first magnetic grains and a first resin;

making a composite body by combining the first compact with the coil; and forming a magnetic body part including the coil by compression molding at least the composite body at a second pressure;

wherein, in the step of forming the magnetic body part, the lead parts are placed on an outside of the first compact, and the magnetic body part is formed through compression molding at the second pressure which is lower than the first pressure.

9. The method for manufacturing a coil component according to claim 8, wherein, in the step of forming the magnetic body part, the magnetic body part is formed by compression-molding at the second pressure the composite body and a second composite magnetic material mixed from second magnetic grains and a second resin.

10. The method for manufacturing a coil component according to claim 8, wherein, in the step of forming the magnetic body part, the magnetic body part is formed by compression-molding at the second pressure the composite body and a second compact that has been formed by compression-molding at a third pressure a second composite magnetic material constituted by a mixture of second magnetic grains and a second resin, wherein the second pressure is lower than the third pressure.

11. The method for manufacturing a coil component according to claim 8, wherein, in the step of forming the magnetic body part, a rate of change in a dimension of the magnetic body part formed from the first compact, relative to a dimension of the first compact, when looking roughly at a center part of the magnetic body part in a direction of compression at the second pressure, is 10% or lower.

12. The method for manufacturing a coil component according to claim 8, wherein, in the step of forming the magnetic body part, the magnetic body part has an external shape formed when put in dies, and is sized so that a maximum dimension of the composite body differs from a maximum dimension between inner faces of the dies by no more than 10%, when viewed along a plane orthogonal to a direction of compression at the second pressure.

13. The method for manufacturing a coil component according to claim 8, wherein, in the step of forming the first compact, the first compact is formed by compression-molding the first composite magnetic material under heating.

14. The method for manufacturing a coil component according to claim 8, wherein, in the step of forming the magnetic body part, the magnetic body part is formed by compression-molding the composite body under heating.

15. The method for manufacturing a coil component according to claim 8, wherein, in the step of making a composite body, the coil is partially bent and assembled to the first compact.

16. The method for manufacturing a coil component according to claim 8, further comprising a step of forming electrodes on a surface of the magnetic body part, after the magnetic body part is polished and insulated at least partially.

17. The method for manufacturing a coil component according to claim 8, wherein a dimension of the magnetic body part in a direction of compression is 0.55 mm or smaller.

* * * * *